US011399584B2

(12) United States Patent
Pietz

(10) Patent No.: US 11,399,584 B2
(45) Date of Patent: Aug. 2, 2022

(54) REMOVABLE PADDED GARMENT AND METHODS FOR USING SAME

(71) Applicant: Ferdinand Heinrich Pietz, Avendale Estates, GA (US)

(72) Inventor: Ferdinand Heinrich Pietz, Avendale Estates, GA (US)

( * ) Notice: Subject to any disclaimer, the term of this patent is extended or adjusted under 35 U.S.C. 154(b) by 0 days.

(21) Appl. No.: 17/215,359

(22) Filed: Mar. 29, 2021

(65) Prior Publication Data

US 2021/0307437 A1 Oct. 7, 2021

Related U.S. Application Data

(60) Provisional application No. 63/004,163, filed on Apr. 2, 2020.

(51) Int. Cl.
*A41D 27/10* (2006.01)
*A41D 27/20* (2006.01)
(Continued)

(52) U.S. Cl.
CPC ..... *A41D 27/10* (2013.01); *A41D 15/00* (2013.01); *A41D 27/20* (2013.01); *A41D 27/26* (2013.01); *A41B 1/08* (2013.01)

(58) Field of Classification Search
CPC .. A41D 27/10; A41D 15/00; A41D 2400/422; A41D 2400/70; A41D 27/26;
(Continued)

(56) References Cited

U.S. PATENT DOCUMENTS 421,520 A * 2/1890 Rosenstock ..... A41D 1/04 2/325
1,426,540 A * 8/1922 Bernstein ..... A41D 13/02 2/79
(Continued)

FOREIGN PATENT DOCUMENTS

CH 660672 A5 6/1987
CN 201860791 U 6/2011
(Continued)

OTHER PUBLICATIONS

International Search Report and Written Opinion dated Jun. 28, 2021 cited in Application No. PCT/US21/24636, 8 pgs.
(Continued)

*Primary Examiner* — Alissa J Tompkins
*Assistant Examiner* — Brieanna Szafran
(74) *Attorney, Agent, or Firm* — Bekiares Eliezer LLP

(57) ABSTRACT

Embodiments of the present disclosure provide a removable padded garment comprised of a set of elements, including, but not limited to: a plurality of configurable arm panels each comprising: a shoulder edge, a hand edge, and at least one arm panel connecting means; and a tubular body panel comprising: a front surface comprising: a plurality of front pocket covers, each of the plurality of front pocket covers comprising a front connecting means, and a plurality of front pockets configured to connect to the shoulder edge in a detached state, and a back surface comprising a plurality of back pockets, and a top surface configured to connect to part of each of the plurality of configurable arm panels a head aperture, a plurality of arm apertures configured to receive the plurality of configurable arm panels in an attached state, and a torso aperture.

8 Claims, 8 Drawing Sheets

(51) Int. Cl.
*A41D 27/26* (2006.01)
*A41D 15/00* (2006.01)
*A41B 1/08* (2006.01)

(58) Field of Classification Search
CPC ... A41D 1/02; A41D 1/04; A41D 3/00; A41D 15/002; A41D 27/20
USPC ..... 2/126
See application file for complete search history.

(56) References Cited

U.S. PATENT DOCUMENTS

| | | | | | |
|---|---|---|---|---|---|
| 2,368,654 | A * | 2/1945 | Frank | A41D 3/00 | 2/94 |
| 2,501,640 | A | 3/1950 | Woodward | | |
| 2,970,316 | A * | 2/1961 | Silin | A45F 3/042 | 224/264 |
| 3,311,924 | A * | 4/1967 | Roark | A41D 3/06 | 2/87 |
| 4,006,495 | A * | 2/1977 | Jones | A41D 3/00 | 2/93 |
| 4,261,059 | A * | 4/1981 | Spitz | A41D 3/00 | 2/108 |
| 4,302,850 | A * | 12/1981 | Maeshima | A41D 27/10 | 2/102 |
| 4,569,089 | A * | 2/1986 | Nesse | A41D 3/00 | 2/102 |
| 5,416,928 | A * | 5/1995 | Koenig | A41D 27/08 | 2/105 |
| 5,628,064 | A | 5/1997 | Chung | | |
| 5,718,000 | A | 2/1998 | Ost et al. | | |
| 6,298,485 | B1 | 10/2001 | Heller | | |
| 6,996,847 | B2 | 2/2006 | Anderson et al. | | |
| 10,420,443 | B2 | 9/2019 | St. John | | |
| 2003/0079277 | A1 | 5/2003 | Gillen et al. | | |
| 2015/0174434 | A1 | 6/2015 | Condon et al. | | |
| 2015/0374044 | A1* | 12/2015 | Kim | A41D 27/201 | 2/300 |
| 2018/0064184 | A1* | 3/2018 | Kuo | A61F 5/37 | |
| 2019/0380403 | A1* | 12/2019 | Schwirtz | A41D 15/00 | |
| 2020/0068964 | A1* | 3/2020 | Brandt | A41D 13/0058 | |
| 2020/0146372 | A1* | 5/2020 | Kwak | A41D 27/20 | |

FOREIGN PATENT DOCUMENTS

| | | | | |
|---|---|---|---|---|
| DE | 3447184 | A * | 7/1985 | A41D 15/007 |
| FR | 2622409 | | 5/1989 | |
| FR | 2622409 | A1 * | 5/1989 | A41D 1/02 |
| FR | 2819384 | A1 * | 7/2002 | A41D 15/00 |
| FR | 2940597 | A1 * | 7/2010 | A41D 15/04 |
| GB | 1589300 | A | 5/1981 | |
| JP | 4697560 | A | 6/2011 | |
| KR | 200281680 | | 7/2002 | |
| KR | 200281681 | Y1 | 7/2002 | |
| NL | 8602646 | A | 5/1988 | |

OTHER PUBLICATIONS

Made by Johnny—MBJ WJC853 Womens Removable Sleeves Bomber Jacket S Turquoise, Walmart.com, https://www.walmart.com/ip/MBJ-WJC853-Womens-Removable-Sleeves-Bomber-Jacket-S-TURQUOISE/119609531, Feb. 5, 2020, 10 pgs.

Men's Black Military Denim Jacket With Removable Sleeves—Punk Design, https://punkdesign.shop/products/punk-rave-mens-black-military-denim-jacket-with-removable-sleeves?variant-592096788497, Feb. 5, 2020, 4 pgs.

Adidas Tops | Adidas Removable Sleeves Ls Shirt Tank Stripes | Poshmark, https://poshmark.com/listing/Adidas-Removable-Sleeves-LS-Shirt-Tank-Stripes-5a74e68107003a5ba00fb6ba, Feb. 5, 2020, 3 pgs.

Ping Mens pullover Long Sleeve Shirt Removable Sleeves 1/4 Front zipper LargeSC8 | eBay, https://www.ebay.com/itm/Ping-Mens-pullover-Long-Sleeve-Shirt-Removable-Sleeves-1-4-Front-zipper-LargeSC8-/143012725235, Feb. 5, 2020, 3 pgs.

* cited by examiner

REMOVABLE PADDED GARMENT AND METHODS FOR USING SAME

RELATED APPLICATION

Under provisions of 35 U.S.C. § 119(e), the Applicant claims the benefit of U.S. Provisional Application No. 63/004,163 filed on Apr. 2, 2020, which is incorporated herein by reference.

It is intended that each of the referenced applications may be applicable to the concepts and embodiments disclosed herein, even if such concepts and embodiments are disclosed in the referenced applications with different limitations and configurations and described using different examples and terminology.

FIELD OF DISCLOSURE

The present disclosure pertains to removable padded garments.

BACKGROUND

Versatile clothing is desirable for a variety of activities. For example, while hunting, a long sleeve shirt is preferred in the beginning of the day when the temperature is cold, while a sleeveless shirt is preferred in the middle, or at the end of the day while hauling a hunted animal back to a vehicle. One conventional approach to this problem is removable sleeves. However, the removed sleeves need space for storage or are otherwise left behind, serving no other purpose, littering the space where the sleeves are left, and impeding the versatility of the shirt. Further, hauling heavy objects such as a hunted animal on one's back can lead to discomfort and even injury. Thus, there is need for an improved approach for removing, storing, and using the removable sleeves on a shirt.

BRIEF OVERVIEW

This brief overview is provided to introduce a selection of concepts in a simplified form that are further described below in the Detailed Description. This brief overview is not intended to identify key features or essential features of the claimed subject matter. Nor is this brief overview intended to be used to limit the claimed subject matter's scope.

In accordance with the purposes of the present disclosure, as embodied and broadly described herein, in one aspect, relates to a removable padded garment for activities, such as, but not limited to, hunting, hiking, or hauling objects on a user's back.

In one aspect, the present disclosure relates to Embodiments of the present disclosure provide a removable padded garment comprised of a set of elements, including, but not limited to: a plurality of configurable arm panels each comprising: a shoulder edge, a hand edge, and at least one arm panel connecting means; and a tubular body panel comprising: a front surface comprising: a plurality of front pocket covers, each of the plurality of front pocket covers comprising a front connecting means, and a plurality of front pockets configured to connect to the shoulder edge in a detached state, and a back surface comprising a plurality of back pockets, and a top surface configured to connect to part of each of the plurality of configurable arm panels a head aperture, a plurality of arm apertures configured to receive the plurality of configurable arm panels in an attached state, and a torso aperture.

In another aspect, the present disclosure relates to a method for padding a garment for activities, the method comprising disconnecting a first shoulder edge of a first configurable arm panel and a second shoulder edge of a second configurable arm panel from at least one arm aperture connected to a tubular body panel; detaching a plurality of front pocket covers from a plurality of front pockets connected to a front surface of the garment; opening each closure means on a plurality of back compartments connected to a back surface of the garment; connecting the first shoulder edge to a first pocket connected to the front surface; connecting the second shoulder edge to a second pocket connected to the front surface; connecting the first configurable arm panel and the second configurable arm panel to a top surface of the garment, the top surface of the garment being disposed above the front surface and the back surface; connecting a first hand edge to at least one of the plurality of back compartments; and connecting a second hand edge to at least one of the plurality of back compartments.

In yet another aspect, the present disclosure relates to a method for padding a garment for activities, the method comprising: disconnecting a first hand edge of a first configurable arm panel from at least one back compartment connected to a back surface of the garment; disconnecting a second hand edge of a second configurable arm panel from the at least one back compartment connected to the back surface of the garment; disconnecting the first configurable arm panel and the second configurable arm panel from a top surface of the garment, the top surface of the garment being disposed above a front surface and the back surface; disconnecting a first shoulder edge of the first configurable arm panel from a first front pocket connected to the front surface of the garment; disconnecting a second shoulder edge of the second configurable arm panel from a second front pocket connected to the front surface; closing at least one closure means of the at least one back compartment connected to the back surface; attaching a first front pocket cover to the first front pocket; attaching a second pocket cover to the second front pocket; connecting the first shoulder edge of the first configurable arm panel to a first arm aperture connected to a tubular body panel; and connecting the second shoulder edge of the second configurable arm panel to a second arm aperture connected to the tubular body panel.

Both the foregoing brief overview and the following detailed description provide examples and are explanatory only. Accordingly, the foregoing brief overview and the following detailed description should not be considered to be restrictive. Further, features or variations may be provided in addition to those set forth herein. For example, embodiments may be directed to various feature combinations and sub-combinations described in the detailed description.

BRIEF DESCRIPTION OF THE DRAWINGS

The accompanying drawings, which are incorporated in and constitute a part of this disclosure, illustrate various embodiments of the present disclosure. The drawings contain representations of various trademarks and copyrights owned by the Applicant. In addition, the drawings may contain other marks owned by third parties and are being used for illustrative purposes only. All rights to various trademarks and copyrights represented herein, except those belonging to their respective owners, are vested in and the property of the Applicant. The Applicant retains and reserves all rights in its trademarks and copyrights included herein, and grants permission to reproduce the material only in connection with reproduction of the granted patent and for no other purpose.

Furthermore, the drawings may contain text or captions that may explain certain embodiments of the present disclosure. This text is included for illustrative, non-limiting, explanatory purposes of certain embodiments detailed in the present disclosure. In the drawings.

DETAILED DESCRIPTION

Figure 1:
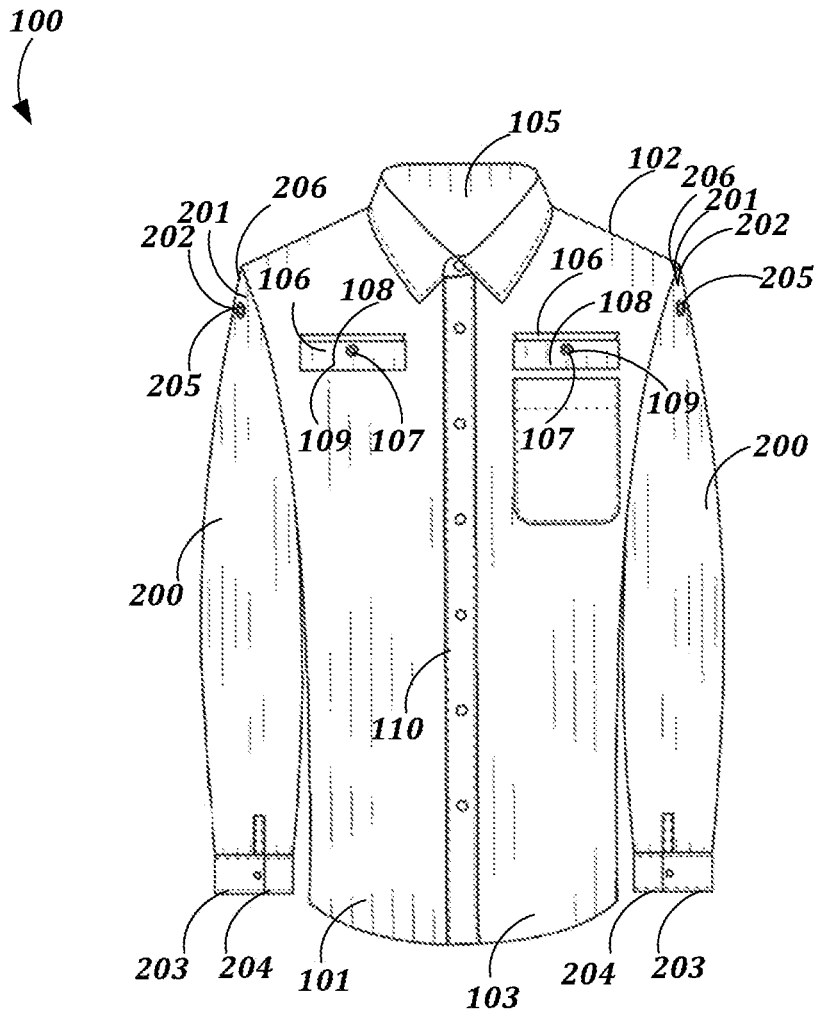
FIG. 1 shows a front perspective depiction of a removable padded garment in accordance with an embodiment of the present disclosure.
Figure 2:
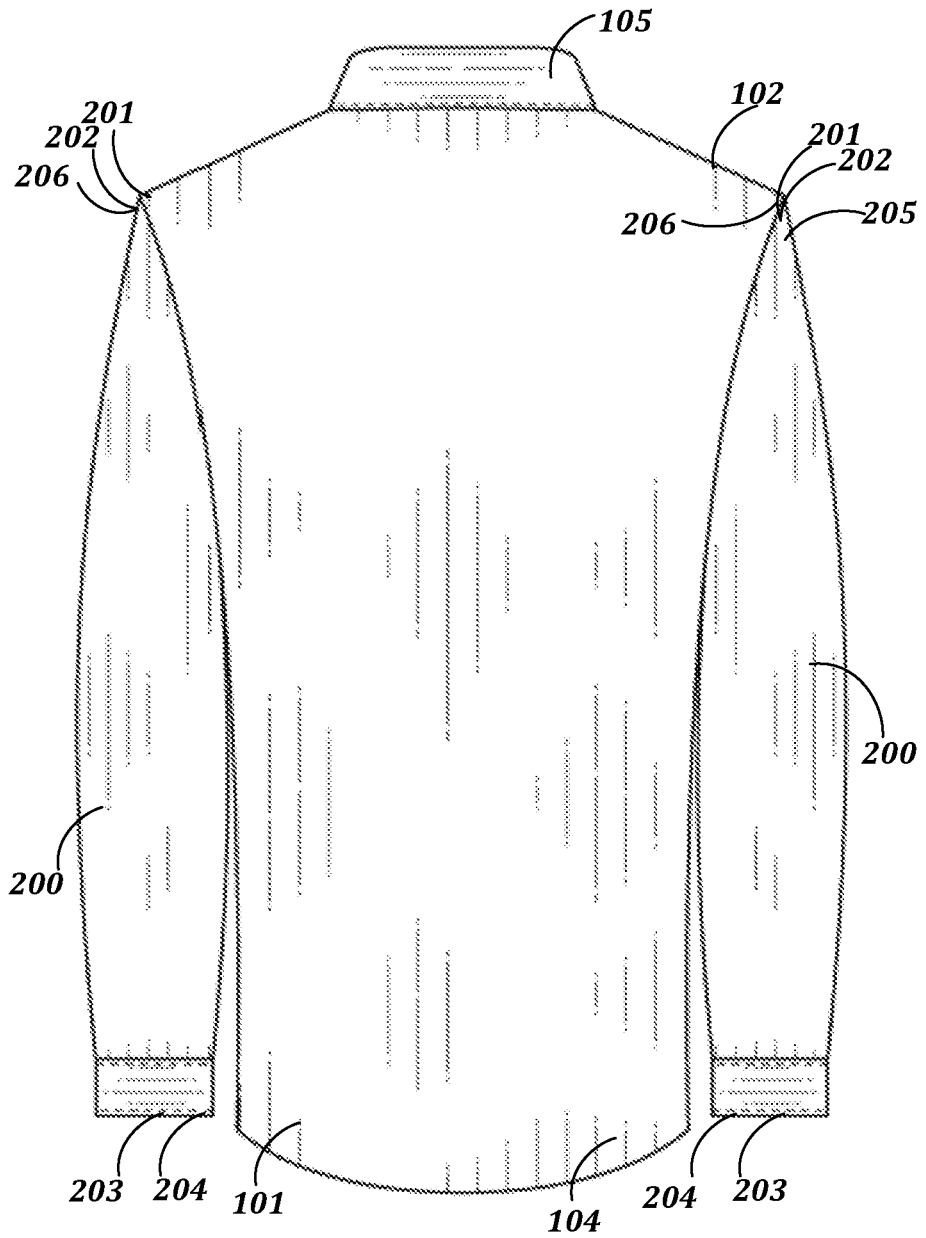
FIG. 2 shows a back perspective depiction of a removable padded garment in accordance with an embodiment of the present disclosure.
Figure 3:
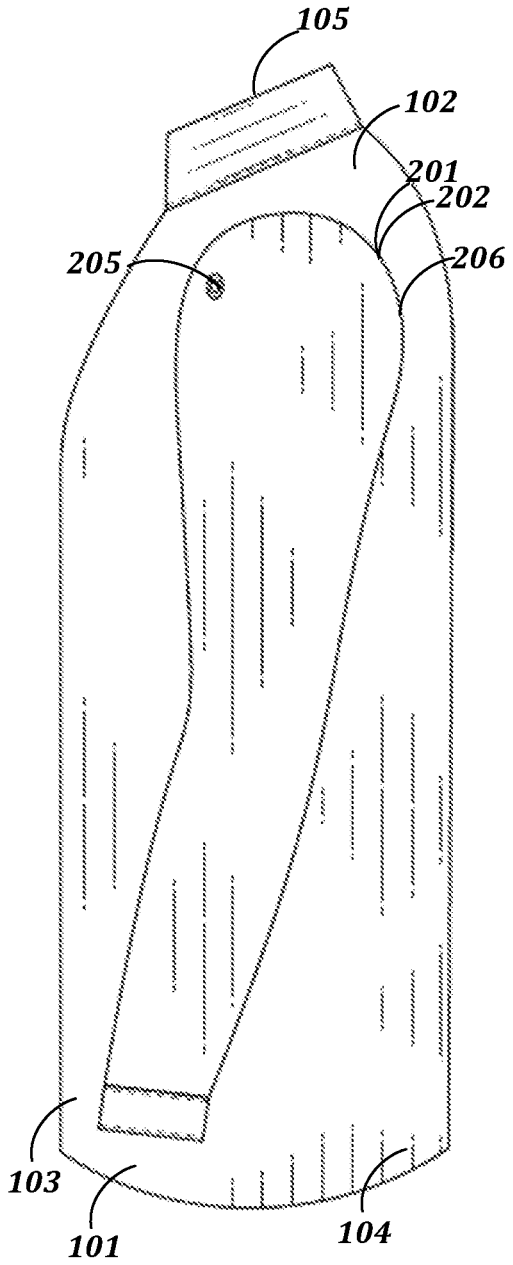
FIG. 3 shows a side perspective depiction of a removable padded garment in accordance with an embodiment of the present disclosure.
Figure 4:
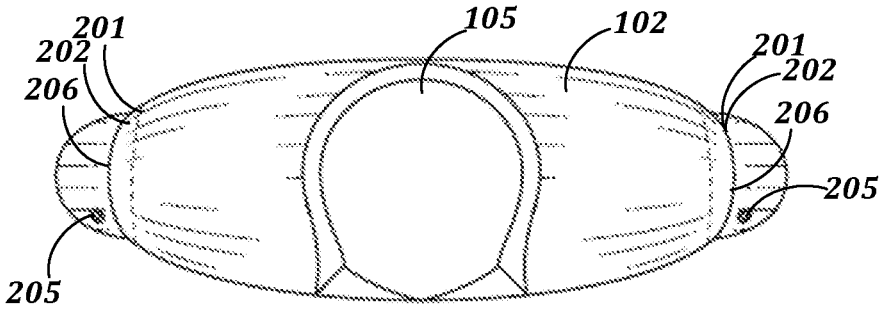
FIG. 4 shows a top perspective depiction of a removable padded garment in accordance with an embodiment of the present disclosure.
Figure 5:
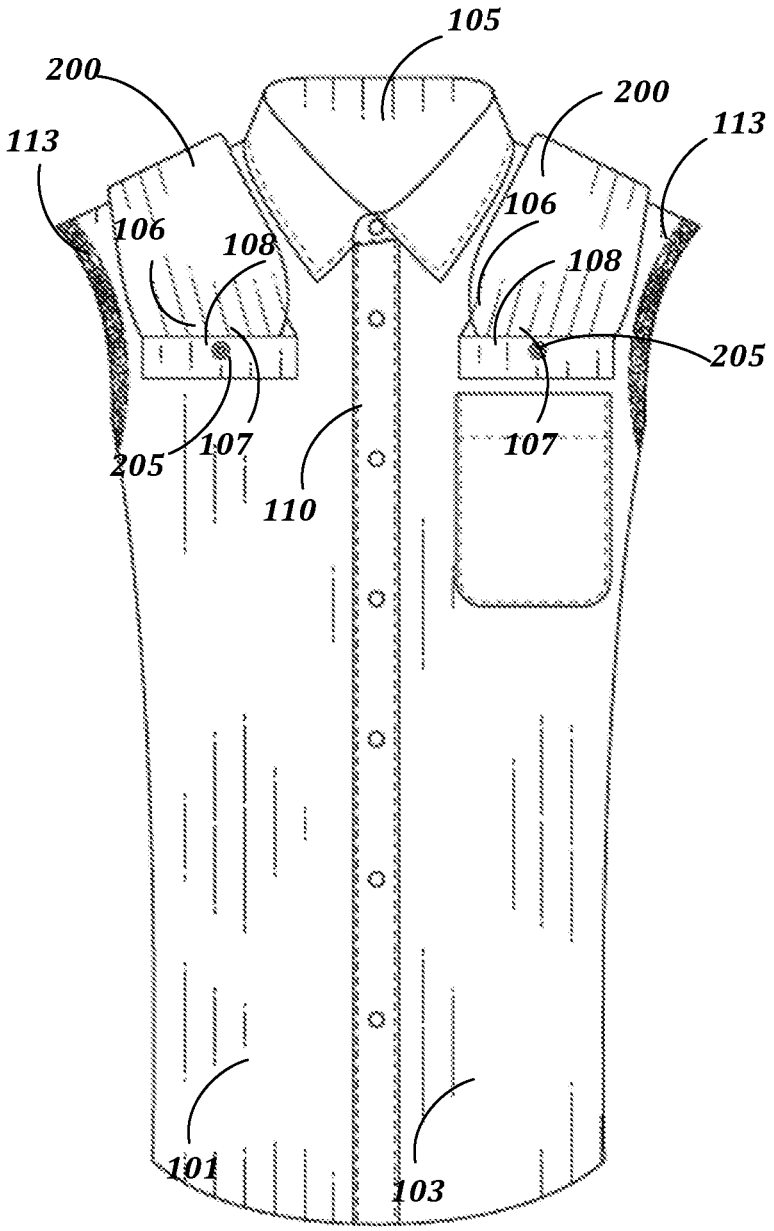
FIG. 5 shows a front perspective depiction of a removable padded garment in accordance with an embodiment of the present disclosure.
Figure 6:
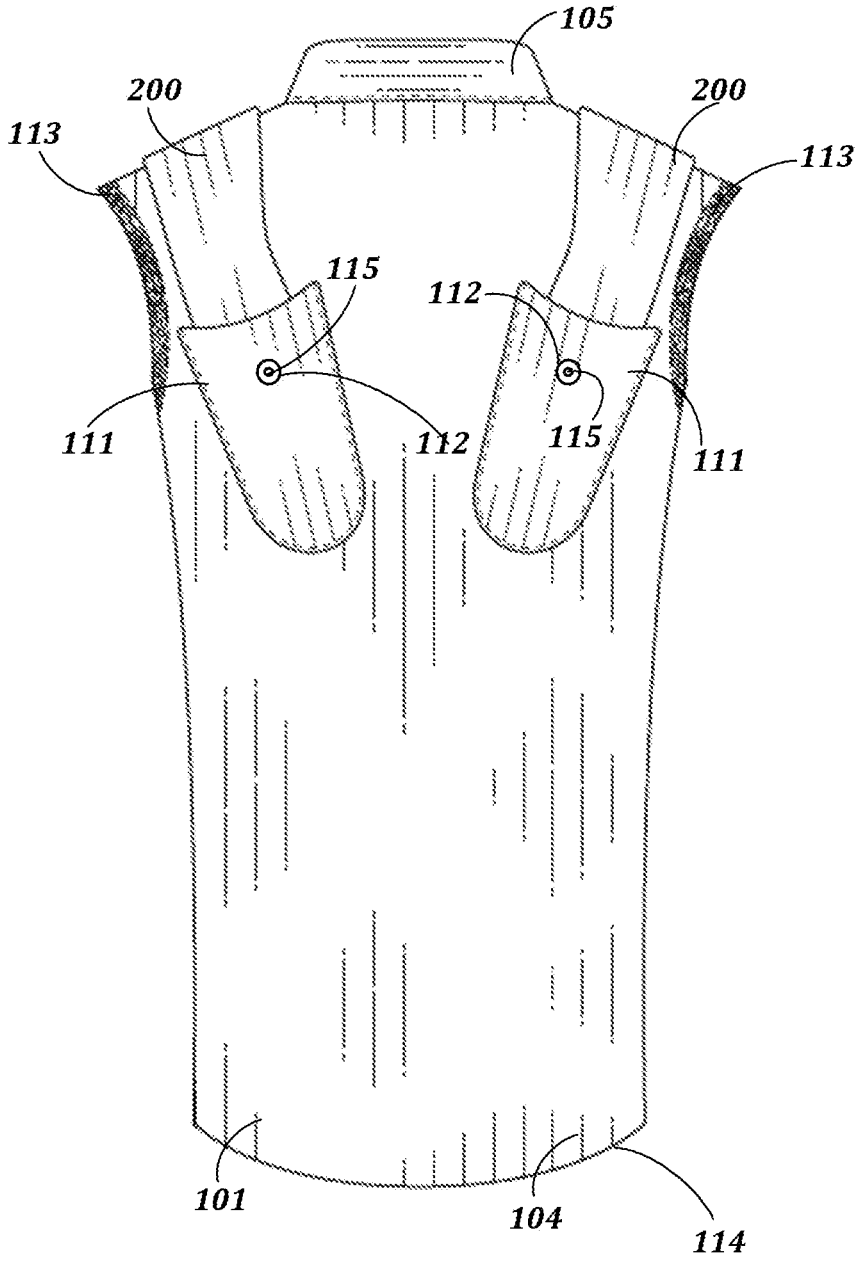
FIG. 6 shows a back perspective depiction of a removable padded garment in accordance with an embodiment of the present disclosure.
Figure 7:
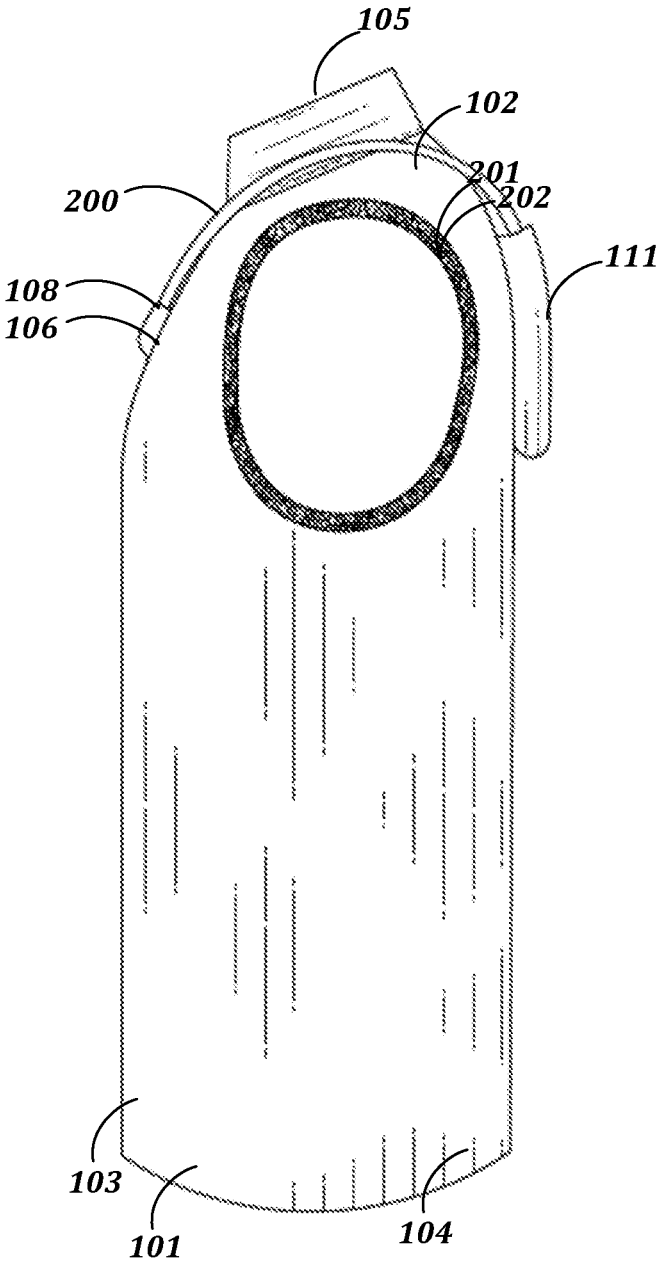
FIG. 7 shows a side perspective depiction of a removable padded garment in accordance with an embodiment of the present disclosure.
Figure 8:
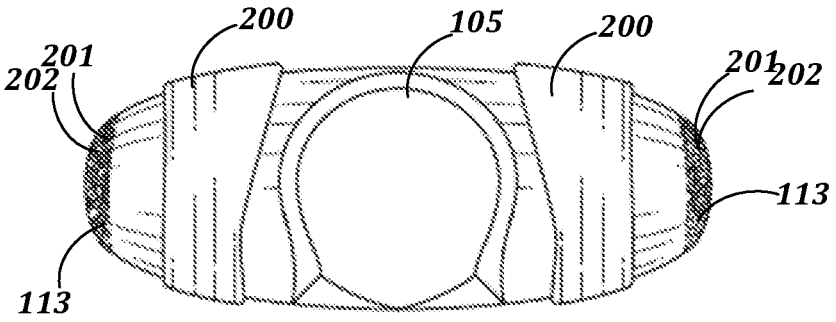
FIG. 8 shows a top perspective depiction of a removable padded garment in accordance with an embodiment of the present disclosure.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative of the present disclosure and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present disclosure. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Regarding applicability of 35 U.S.C. § 112, ¶6, no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims. The present disclosure contains headers. It should be understood that these headers are used as references and are not to be construed as limiting upon the subjected matter disclosed under the header.

The present disclosure includes many aspects and features. Moreover, while many aspects and features relate to, and are described in, the context of a removable padded garment and methods for using same, embodiments of the present disclosure are not limited to use only in this context.

I. GARMENT OVERVIEW

This overview is provided to introduce a selection of concepts in a simplified form that are further described below. This overview is not intended to identify key features or essential features of the claimed subject matter. Nor is this overview intended to be used to limit the claimed subject matter's scope.

Embodiments of the present disclosure provide a removable padded garment comprised of a set of elements, including, but not limited to a tubular body panel and a plurality of configurable arm panels. By way of non-limiting example, the plurality of configurable arm panels may connect to the tubular body panel. In further embodiments, the plurality of configurable arm panels may be disconnected from the tubular body panel.

Embodiments of the present disclosure may comprise methods and systems comprising, but not limited to, at least one of the following:

A. A Tubular Body Panel; and

B. A Plurality of Configurable Arm Panels.

Details with regards to each panel is provided below. Although panels are disclosed with specific functionality, it should be understood that functionality may be shared between panels, with some functions split between panels, while other functions duplicated by the panels. Furthermore, the name of the panel should not be construed as limiting upon the functionality of the panel. Moreover, each component disclosed within each panel can be considered independently without the context of the other components within the same panel or different panels. Each component may contain language defined in other portions of this specifications. Each component disclosed for one panel may be mixed with the functionality of another panel. In the present disclosure, each component can be claimed on its own and/or interchangeably with other components of other panels.

The following depicts an example of a method of a plurality of methods that may be performed by at least one of the aforementioned panels, or components thereof. Various materials may be used at the various stages of operations disclosed with reference to each panel. For example, at least one garment 100 may be employed in the performance of some or all of the stages disclosed with regard to the methods.

Furthermore, although the stages of the following example method are disclosed in a particular order, it should be understood that the order is disclosed for illustrative purposes only. Stages may be combined, separated, reordered, and various intermediary stages may exist. Accordingly, it should be understood that the various stages, in various embodiments, may be performed in arrangements that differ from the ones claimed below. Moreover, various stages may be added or removed without altering or deterring from the fundamental scope of the depicted methods and systems disclosed herein.

Consistent with embodiments of the present disclosure, a method may be performed by at least one of the panels disclosed herein. The method may be embodied as, for example, but not limited to, instructions, which when executed, perform the method. The method may comprise the following stages:

disconnecting at least one shoulder edge of a plurality of configurable arm panels from at least one arm aperture connected to a tubular body panel;

detaching a plurality of pocket covers from a plurality of pockets connected to a front surface;

opening a plurality of closure means on a plurality of compartments connected to a back surface;

connecting first shoulder edge to a first pocket connected to the front surface;

connecting a second shoulder edge to a second pocket connected to the front surface;

connecting the plurality of configurable arm panels to the top surface; and connecting at least one hand edge to at least one pocket connected to the back surface.

In various embodiments, the pocket may not comprise covers. Furthermore, connecting means may be attached to the configurable arm panels rather than the pockets, and vice versa. In yet further embodiments, connection may not occur at the top surface, but at a front and/or back surface, mid surface, and/or lower surface.

Both the foregoing overview and the following detailed description provide examples and are explanatory only. Accordingly, the foregoing overview and the following detailed description should not be considered to be restrictive. Further, features or variations may be provided in addition to those set forth herein. For example, embodiments may be directed to various feature combinations and subcombinations described in the detailed description.

A tubular garment body panel may be provided. The tubular garment body panel may comprise a top surface, at least one configurable arm panel (e.g., a detachable sleeve), and a plurality of securing means to attach and detach the at least one configurable arm panel. Consistent with the with the embodiments of the present disclosure, the tubular body panel may comprise a top surface covering at least a portion of the user's shoulders. The top surface may be used for a user's shoulders to be at least partially covered and protected when the tubular body panel is worn by the user. In some embodiments, the top surface may comprise a plurality of securing means. The plurality of securing means may be used to secure sleeves associated with the tubular garment body panel. connected sleeves are further secured as not to fall off. In some embodiments, the top surface may comprise a guiding means. The guiding means may be used for the connected sleeves to be more easily worn and removed.

In some embodiments, the tubular body panel may omit a top surface, and comprise the front surface, the back surface, and the at least one configurable arm panel (e.g., a blouse). In further embodiments, the at least one configurable arm panel may connect to the front surface, over the shoulders, and onto the back surface, giving the tubular body panel shoulder cover. In further embodiments, the at least one arm panel may comprise at least one arm panel connecting means.

Consistent with the with the embodiments of the present disclosure, the tubular body panel may comprise a front surface. The front surface may protect and cover the user's torso and chest. In some embodiments, the front surface may connect to the top surface. In some embodiments, the front surface may comprise a plurality of pockets. In further embodiments, items may be stored in the pockets. In yet further embodiments, the pockets may be used to connect the plurality of configurable arm panels to the tubular body panel. In yet further embodiments, the plurality of pockets may comprise at least one connecting means. The plurality of pockets may reside on the top half of the front surface. In some embodiments, the location of the plurality of pockets may be used for items in the pocket to be easily accessible. In still further embodiments, the front surface may comprise at least one front closure means.

In some embodiments, the front surface may further comprise a plurality of pocket covers. In some embodiments, the plurality of pocket covers may comprise a first pocket cover and/or a second pocket cover. In some embodiments, the plurality of pocket covers may be configured to be in an upward facing position and/or a downward facing position. In further embodiments, the plurality of pocket covers may protect the plurality of pockets. In yet further embodiments, the plurality of pocket covers may comprise a plurality of connecting means. In even further embodiments, the pocket covers may connect to the pocket or the plurality of configurable arm panels. The front surface may further comprise a plurality of connecting means. In some embodiments, the plurality of configurable arm panels may connect to the front surface via the connecting means. In some embodiments, the front surface may further comprise at least one closure means that may selectively adjust at least one opening size from a fully open position to a fully closed position. In some embodiments, the at least one closure means may be used for the user to have a plurality of options for which to wear the garment. In some embodiments, the at least one closure means may be used for the user to wear and disrobe the tubular body panel with increased efficiency.

Consistent with the with the embodiments of the present disclosure, the tubular body panel may comprise a back surface to protect and cover the user's back. The back surface may comprise a plurality of connecting means. The plurality of connecting means may be used for the plurality of configurable arm panels to connect to the back surface. In some embodiments, the back surface may further comprise a plurality of compartments and/or back compartments. In further embodiments, the plurality of compartments and/or back compartments connected to the back surface may be used to connect the plurality of configurable arm panels. In yet further embodiments, the plurality of compartments connected to the back surface may comprise a plurality of connecting means. In some embodiments, the plurality of configurable arm panels may connect to the plurality of compartments connected to the back surface. In further embodiments, the plurality of compartments connected to the back surface may further comprise at least one closure means and/or back closure means. In yet further embodiments, the plurality of compartments connected to the back surface may be used to selectively adjust at least one opening size, via the closure means and/or back closure means, from a fully open position to a fully closed position. In yet further embodiments, the plurality of compartments connected to the back surface may further comprise at least one aperture. In even further embodiments, the at least one aperture may be located on the bottom half of the plurality of compartments connected to the back surface. In even yet further embodiments, the at least one aperture may be used for undesired liquid or debris to easily exit the plurality of compartments connected to the back surface.

Consistent with the with the embodiments of the present disclosure, the tubular body panel may comprise a head aperture. The head aperture may be used for the user's head to securely fit through the tubular body panel. In further embodiments, the tubular body panel may comprise a plurality of head aperture edges.

Consistent with the with the embodiments of the present disclosure, the tubular body panel may comprise a plurality of arm apertures. The plurality of arm apertures may be used for the user's arms to securely fit through the tubular body panel and/or receive a least one arm of the user. The plurality of arm apertures may comprise at least one arm aperture edge. Further, the plurality of configurable arm panels may connect to the plurality of arm apertures. In further embodiments, the tubular body panel may comprise a plurality of arm aperture edges.

Consistent with the embodiments of the present disclosure, the tubular body panel may comprise a torso aperture. The torso aperture may be used for the user's body to securely fit in the tubular body panel. In further embodiments, the tubular body panel may comprise a plurality of torso aperture edges.

A plurality of configurable arm panels (e.g., short sleeves, long sleeves, ¾ sleeves, sleeves with cuffs) may be provided. In some embodiments, the plurality of configurable arm panels may comprise a first configurable arm panel and/or a second configurable arm panel. The plurality of configurable arm panels may comprise at least one shoulder edge defining at least one shoulder aperture. The at least one shoulder aperture may be used for the user's arms to fit into the plurality of configurable arm panels. The at least one shoulder edge may comprise a connecting means. In some embodiments, the connecting means may be used for the at least one shoulder edge to connect to the tubular body panel. In further embodiments, the connecting means may be used for the at least one shoulder edge to connect to the plurality of arm aperture edges. The plurality of configurable arm panels may further comprise a hand edge defining a hand aperture. The hand aperture may be used for the user's hands to fit securely through the plurality of configurable arm panels. The plurality of configurable arm panels may further comprise at least one connecting means. In some embodiments, the plurality of configurable arm panels may connect to the tubular body panel.

II. GARMENT CONFIGURATION

FIG. 1 illustrates one possible operating environment through which garment 100 consistent with embodiments of the present disclosure may be provided.

Accordingly, embodiments of the present disclosure provide tubular body panel 101, and a plurality of configurable arm panels 200.

In some embodiments, garment 100 may be sized to fit all body types and sizes. In further embodiments, garment 100 may be unisex, for example, it may fit men and women.

In further embodiments, at least a portion of garment 100 may be configured to be in an attached state, and a detached state.

A. A Tubular Body Panel

Consistent with embodiments of the present disclosure, tubular body panel 101 may be provided.

In some embodiments, tubular body panel 101 may comprise top surface 102, front surface 103, and a back surface 104. In further embodiments, head aperture 105 may reside on top surface 102. Head aperture 105 may be used for a user's head to securely fit through tubular body panel 101.

Furthermore, various embodiments of tubular body panel 101 may comprise a top surface 102. Top surface 102 may connect with front surface 103. In some embodiments, pockets 106 may connect to front surface 103. In further embodiments, pockets 106 may comprise at least one connecting means 107.

In some embodiments, front surface 103 may comprise pocket covers 108. In further embodiments, pocket covers 108 may comprise at least one connecting means 109. In yet further embodiments, pocket covers 108 may reside above pockets 106. In still further embodiments, pocket covers 108 may connect to front surface 103 by at least one edge. In even further embodiments, pockets 106 may have a closed position in which, for example, pocket cover 108 and pocket 106 connect. In yet even further embodiments, pockets 106 may have an open position in which, for example, pocket cover 108 and pocket 106 are not connected.

In some embodiments, front surface 103 may comprise a plurality of connecting means not shown in the figures.

In some embodiments, front surface 103 may comprise at least one closure means 110 that may selectively adjust at least one opening size from a fully open position to a fully closed position. The at least one closure means may be used for the user to have a plurality of options for which to wear garment 100.

Front surface 103 may connect to back surface 104. Back surface 104 may connect with top surface 102. In some embodiments, a plurality of compartments 111 may connect to back surface 104. In further embodiments, compartments 111 may comprise at least one connecting means 112. In yet Further embodiments, compartments 111 may comprise at least one closure means 115.

Tubular body panel 101 may comprise a plurality of arm apertures 113. Plurality of arm apertures 113 may be used for the user's arms to securely fit through tubular body panel 101. In some embodiments, configurable arm panels 200 may connect to arm apertures 113.

Tubular body panel 101 may comprise a torso aperture 114. Torso aperture 114 may be used for the user's body to securely fit in tubular body panel 101.

B. A Plurality of Configurable Arm Panels

In some embodiments, consistent with the present disclosure, configurable arm panels 200 (e.g., short sleeves, long sleeves, ¾ sleeves, sleeves with cuffs) may be provided.

The plurality of configurable arm panels 200 may comprise at least one shoulder edge 201 defining at least one shoulder aperture 202. At least one shoulder aperture 202 may be used for the user's arms to fit into configurable arm panels 200. Shoulder edge 201 may comprise a connecting means 206. The connecting means may be used to connect to arm apertures 113. Configurable arm panels 200 may further comprise a hand edge 203 defining hand aperture 204. The hand aperture may be used for the user's hands to fit securely through configurable arm panels 200. In some embodiments, configurable arm panels 200 may further comprise at least one connecting means 205. In further embodiments, configurable arm panels 200 may connect to tubular body panel 101. In one embodiment, each of the plurality of configurable sleeves, when in a first configuration of the detached state, is detached from the corresponding one of the plurality of arm apertures, and is partially retained at the hand edge of each configurable sleeve of the plurality of configurable sleeves by a corresponding one of the plurality of back pockets and at the shoulder edge of each configurable sleeve of the plurality of configurable sleeves by a corresponding one of the plurality of front pockets, and contacts the front surface, the top surface, and the back surface of the tubular body panel, such that each configurable sleeve of the plurality of configurable sleeves passes over the shoulder portion on the exterior side of the tubular body panel. Further, wherein when each of the plurality of configurable sleeves, when in a second configuration of the detached state, is configured to be detached from the corresponding one of the plurality of arm apertures such that the hand edge of each configurable sleeve of the plurality of configurable sleeves contacts a corresponding one of the plurality of front pockets and the shoulder edge of each configurable sleeve of the plurality of configurable sleeves is configured to be in contact with a corresponding one of the plurality of back pockets

III. GARMENT METHOD OF USE

Embodiments of the present disclosure provide garment 100 operative by a set of instructions configured to operate the aforementioned panels in accordance with the methods. The following depicts an example of a plurality of methods that may be performed by at least one of the aforementioned panels. Various components may be used at the various stages of operations disclosed with reference to each panel.

Embodiments of the present disclosure provide garment 100 operative as a system of panels. The method may comprise the following stages:

A. Method of Padding a Garment for Activities

A method for padding garment 100 may comprise, but not be limited to, the following steps:

- Disconnecting at least one shoulder edge of a plurality of configurable arm panels from at least one arm aperture connected to a tubular body panel;
- Detaching a plurality of pocket covers from a plurality of pockets connected to a front surface of a garment;
- Opening a plurality of closure means on a plurality of compartments connected to a back surface of a garment;
- Connecting a first shoulder edge to a first pocket connected to the front surface;
- Connecting a second shoulder edge to a second pocket connected to the front surface;
- Connecting the plurality of configurable arm panels to the top surface; and
- Connecting at least one hand edge to at least one compartment connected to the back surface.

B. Method for Attaching Sleeves

A method for attaching sleeves to garment 100 may comprise, but not be limited to, the following steps:

- Disconnecting at least one hand edge 203 from at least one compartment connected to back surface 104;
- Disconnecting configurable arm panels 200 from top surface 102;
- Disconnecting first shoulder edge 201 to first pocket 105 connected to front surface 103;
- Disconnecting second shoulder edge 201 to second pocket 105 connected to front surface 103;
- Closing closure means 115 on pockets 111 connected to back surface 104;
- Attaching pocket covers 108 on pockets 106 connected to front surface 103; and
- Connecting at least one shoulder edge 201 of a plurality of configurable arm panels 200 from at least one arm aperture 113 connected to a tubular body panel 101.

IV. ASPECTS

Aspect 1. The garment of claim 1, wherein the shoulder edge defines a shoulder aperture.

Aspect 2. The garment of claim 1, wherein the hand edge defines a hand aperture.

Aspect 3. The garment of claim 1, wherein the front surface further comprises at least one front closure means.

V. CLAIMS

While the specification includes examples, the disclosure's scope is indicated by the following claims. Furthermore, while the specification has been described in language specific to structural features and/or methodological acts, the claims are not limited to the features or acts described above. Rather, the specific features and acts described above are disclosed as example for embodiments of the disclosure.

Insofar as the description above and the accompanying drawing disclose any additional subject matter that is not within the scope of the claims below, the disclosures are not dedicated to the public and the right to file one or more applications to claims such additional disclosures is reserved.

The invention claimed is:

1. A garment comprising:

a plurality of configurable sleeves, each comprising:

a shoulder edge, a hand edge, wherein the shoulder edge is opposite to the hand edge and at least one sleeve connecting means; and a tubular body panel having an interior surface opposite to an exterior surface, a head aperture, a torso aperture, and a plurality of arm apertures configured to detachably connect to the plurality of configurable sleeves when the plurality of configurable sleeves are in an attached state, the tubular body panel comprising:

a front surface of the exterior surface comprising:

a plurality of front pocket covers, each of the plurality of front pocket covers comprising a front connecting means, and a plurality of front pockets disposed on the exterior surface of the tubular body panel, the plurality of front pockets comprising a plurality of connecting means configured to be releasably connected to the shoulder edges of the plurality of configurable sleeves, respectively, when the plurality of configurable sleeves are in a detached state from the plurality of arm apertures, a back surface of the exterior surface comprising a plurality of back pockets disposed on the exterior surface of the tubular body panel, the plurality of back pockets being separate from the plurality of front pockets, the plurality of back pockets comprising a plurality of connecting means configured to be releasably connected to the hand edges of the plurality of configurable sleeves, respectively, when the plurality of configurable sleeves are in the detached state from the plurality of arm apertures, a top surface of the tubular body panel corresponding to a shoulder portion of the garment, the top surface configured to detachably connect to part of each of the plurality of configurable sleeves in the detached state from the plurality of arm apertures, wherein each of the plurality of configurable sleeves, when in the attached state, is connected to a corresponding one of the plurality of arm apertures at the shoulder edge of each configurable sleeve of the plurality of configurable sleeves, and wherein each of the plurality of configurable sleeves, when in a first configuration of the detached state, is detached from the corresponding one of the plurality of arm apertures, and is partially retained at the hand edge of each configurable sleeve of the plurality of configurable sleeves by a corresponding one of the plurality of back pockets and at the shoulder edge of each configurable sleeve of the plurality of configurable sleeves by a corresponding one of the plurality of front pockets, and contacts the front surface, the top surface, and the back surface of the tubular body panel, such that each configurable sleeve of the plurality of configurable sleeves passes over the shoulder portion on the exterior side of the tubular body panel and wherein when each of the plurality of configurable sleeves, when in a second configuration of the detached state, is configured to be detached from the corresponding one of the plurality of arm apertures such that the hand edge of each configurable sleeve of the plurality of configurable sleeves contacts a corresponding one of the plurality of front pockets and the shoulder edge of each configurable sleeve of the plurality of configurable sleeves is configured to be in contact with a corresponding one of the plurality of back pockets.

2. The garment of claim 1, wherein the plurality of back pockets further comprise at least one back closure means.

3. The garment of claim 1, wherein the at least one sleeve connecting means is proximate to the shoulder edge.

4. The garment of claim 1, wherein in the attached state, the plurality of configurable sleeves is configured to receive at least one arm of a user of the garment.

5. The garment of claim 1, wherein the plurality of arm apertures are disposed between the front surface, the back surface, and the top surface.

6. The garment of claim 1, wherein the plurality of arm apertures each comprises an arm aperture edge.

7. The garment of claim 6, wherein the arm aperture edge is configured to connect to the shoulder edge of the plurality of configurable sleeves in the attached state.

8. The garment of claim 1, wherein the plurality of configurable sleeves further comprises a first sleeve and a second sleeve.

* * * * *